US007131863B2

(12) United States Patent
Lebo et al.

(10) Patent No.: US 7,131,863 B2
(45) Date of Patent: Nov. 7, 2006

(54) METHOD OF SIMPLIFYING PLACEMENT OF JUMPERS USING TEMPLATES

(75) Inventors: Levi Lebo, Vancouver, WA (US); Charles Michael Pickett, Brush Prairie, WA (US); James Owen, Vancouver, WA (US)

(73) Assignee: Sharp Laboratories of America, Inc., Camus, WA (US)

( * ) Notice: Subject to any disclaimer, the term of this patent is extended or adjusted under 35 U.S.C. 154(b) by 0 days.

(21) Appl. No.: 10/892,714

(22) Filed: Jul. 16, 2004

(65) Prior Publication Data

US 2006/0014420 A1 Jan. 19, 2006

(51) Int. Cl.
*H01R 31/08* (2006.01)

(52) U.S. Cl. ..... 439/507; 439/511

(58) Field of Classification Search ..... 439/507, 439/510, 511, 512; 200/5 D, 5 E, 51.02, 200/51.16, 510, 520, 341
See application file for complete search history.

(56) References Cited

U.S. PATENT DOCUMENTS 2,550,623 A * 4/1951 Teruzzi ..... 200/558
4,030,793 A * 6/1977 Hanlon et al. ..... 439/511
4,090,667 A * 5/1978 Crimmins ..... 439/511
4,356,361 A * 10/1982 Schwab ..... 439/511
4,670,630 A * 6/1987 Kikta et al. ..... 200/16 C
4,676,566 A * 6/1987 Abe ..... 439/507
5,051,870 A * 9/1991 Companion ..... 361/773
5,281,165 A * 1/1994 McCleerey et al. ..... 439/510
6,454,585 B1 * 9/2002 Homer et al. ..... 439/507
2003/0008551 A1 1/2003 Chang ..... 439/512

FOREIGN PATENT DOCUMENTS

JP 9259996 10/1997

* cited by examiner

*Primary Examiner*—Tho D. Ta
*Assistant Examiner*—Vanessa Girardi
(74) *Attorney, Agent, or Firm*—Kirton & McConkie; Michael F. Krieger

(57) ABSTRACT

Each of a plurality of jumper templates is configured to fit over a jumper block. Each jumper template contains a set of jumpers disposed to connect to pin pairs on the jumper block and thereby set the jumper block to one of a permissible setting for the jumper block. A jumper template may include a key that corresponds to a physical feature of the jumper block to ensure proper orientation of the jumper template with respect to the jumper block. Alternatively, a jumper template includes a jumper for each pin pair of a jumper block. Buttons are configured to move sets of the jumpers into or out of position to short selected pin pairs of the jumper block. The buttons correspond to permissible settings of the jumper block.

12 Claims, 6 Drawing Sheets

METHOD OF SIMPLIFYING PLACEMENT OF JUMPERS USING TEMPLATES

BACKGROUND

A jumper block may be used in an electronic device to affect settings or selections for the electronic device. FIG. 1 illustrates an exemplary jumper block 102, which includes pairs 106, 108, 110, and 112 of conductive pins disposed on a substrate 104. The pins are electrically connected to the electronic device (not shown). Shorting one or more pin pairs 106, 108, 110, and/or 112 affects a particular setting for the electronic device. A jumper is typically used to electrically short a pair of pins. An exemplary jumper 114 is shown in FIGS. 1 and 2. As shown in FIG. 2, a jumper 114 may comprise a housing 202 (typically nonconductive) with holes 204 that correspond to a pair of pins on the jumper block. The holes 204 are conductive and electrically connected within the housing 202. When jumper 114 is slid onto a pin pair (e.g., onto pin pair 112 as shown in FIG. 1), the jumper 114 shorts the pin pair (e.g., 112).

Jumper blocks are commonly used on electronic devices, such as computer mother boards. For example, a jumper block may be used on a computer motherboard to set which of two disk drive interfaces is to be master and which is to be slave. As another example, a jumper block may also be used to set input/output addresses, interrupts, and other settings on a motherboard. The foregoing are only a few examples of the use of jumper blocks to affect settings or selections on an electronic device. There are often multiple jumpers on a single jumper block that enable different settings.

Jumper blocks, however, are not always easy to use. For example, it may not be clear which pin pairs correspond to which settings or selections. For example, the orientation of the jumper block may not be clear. Incorrect settings may damage the electronic device. Moreover, the pins are often small and may break easily.

BRIEF SUMMARY

In an embodiment of the invention, each of a plurality of jumper templates is configured to fit over a jumper block. Each jumper template contains a set of jumpers disposed to connect to a particular combination of pin pairs on the jumper block and thereby set the jumper block to one of the permissible settings for the jumper block. A jumper template may include a key that corresponds to a physical feature of the jumper block to ensure proper orientation of the jumper template with respect to the jumper block.

In another embodiment, a jumper template includes a jumper for each pin pair of a jumper block. Buttons are configured to move sets of the jumpers into or out of position to short selected pin pairs of the jumper block. The buttons correspond to permissible settings of the jumper block.

DETAILED DESCRIPTION OF EXEMPLARY EMBODIMENTS

Although this specification describes exemplary embodiments and applications of the invention, the invention is not limited to these exemplary embodiments and applications or to the manner in which the exemplary embodiments and applications operate or are described herein.

Figure 1:
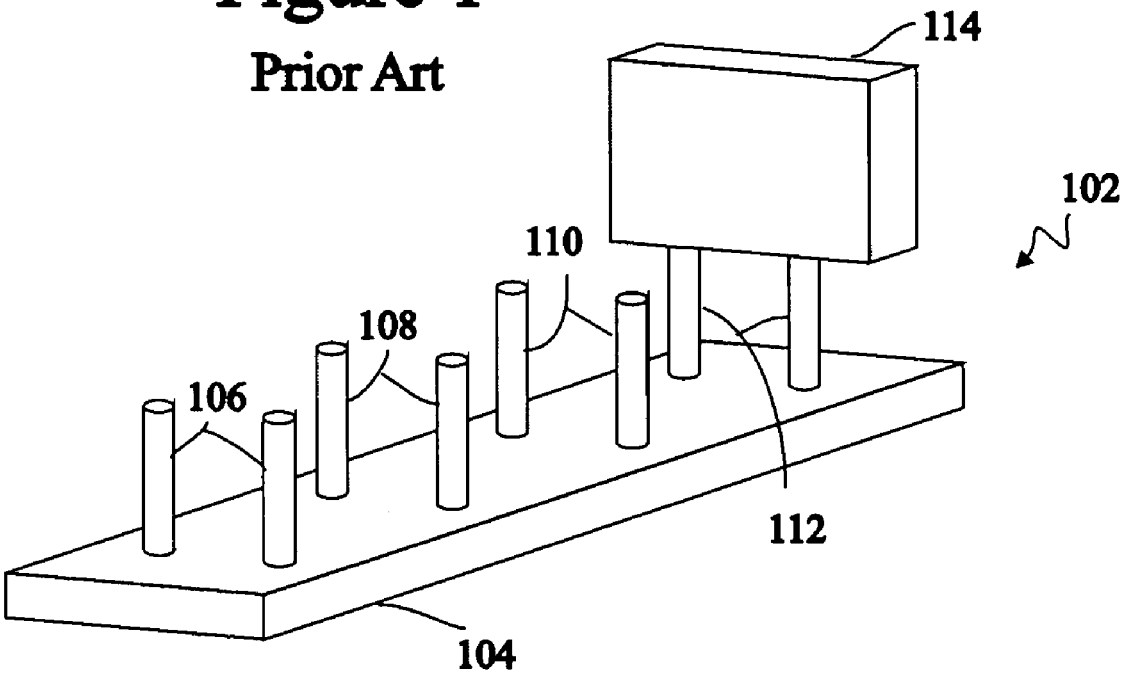
Figure 1 Prior Art
FIG. 1 shows a prior art jumper block and jumper.
Figure 2:
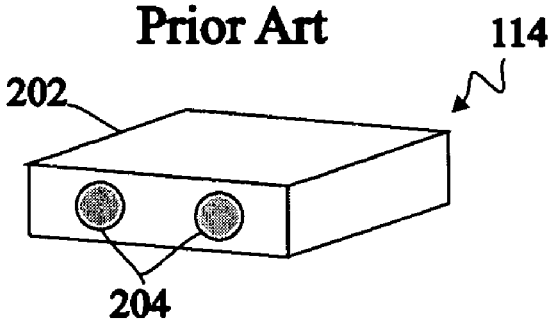
Figure 2 Prior Art
FIG. 2 shows a prior art jumper.
Figure 3:
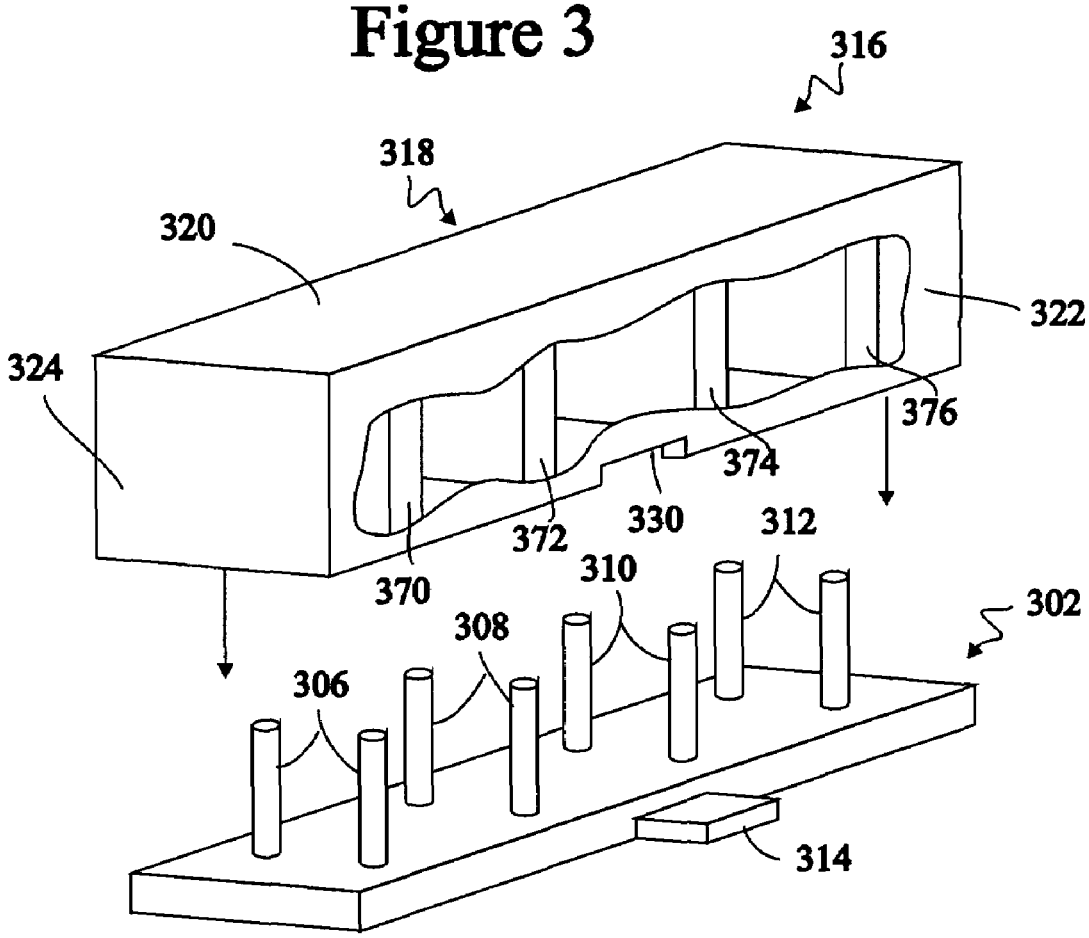
FIG. 3 shows a perspective view of an exemplary jumper template and jumper block.

FIG. 3 shows a perspective view of a jumper template 316 with a cut out to show jumpers 370, 372, 374, and 376. Jumper template 316 is configured to hold four jumpers 370, 372, 374, and 376 corresponding to the four pin pairs 306, 308, 310, and 312 of the jumper block 302 and to fit onto a jumper block 302. Multiple jumper templates, like jumper template 316 may be made, each holding a different combination of jumpers (e.g., 370, 372, 374, and/or 376) such that each template corresponds to one possible setting of the jumper block 302. Thus, although jumper template 316 is shown in FIG. 3 with four jumpers 370, 372, 374, and 376, jumper templates 316 for jumper block 302 may be made that include only three jumpers disposed to correspond to and short any three of pin pairs 306, 308, 310, and 312. Likewise, jumper templates 316 may be made that include only two jumpers disposed to correspond to and short any two of pin pairs 306, 308, 310, and 312. Of course, jumper templates 316 may be made that include only one jumper disposed to correspond to and short any one of pin pairs 306, 308, 310, and 312. In this way, a set of jumper templates, like jumper template 316, may be made that corresponds to every possible setting of jumper block 302. It should be noted that non-conducting "fake" jumpers that do not short a pin pair may be placed over pin pairs that are not to be shorted. For example, such fake jumpers may provide extra stability or may protect the unused pins on a jumper block from, for example, inadvertently being bent.

Figure 4:
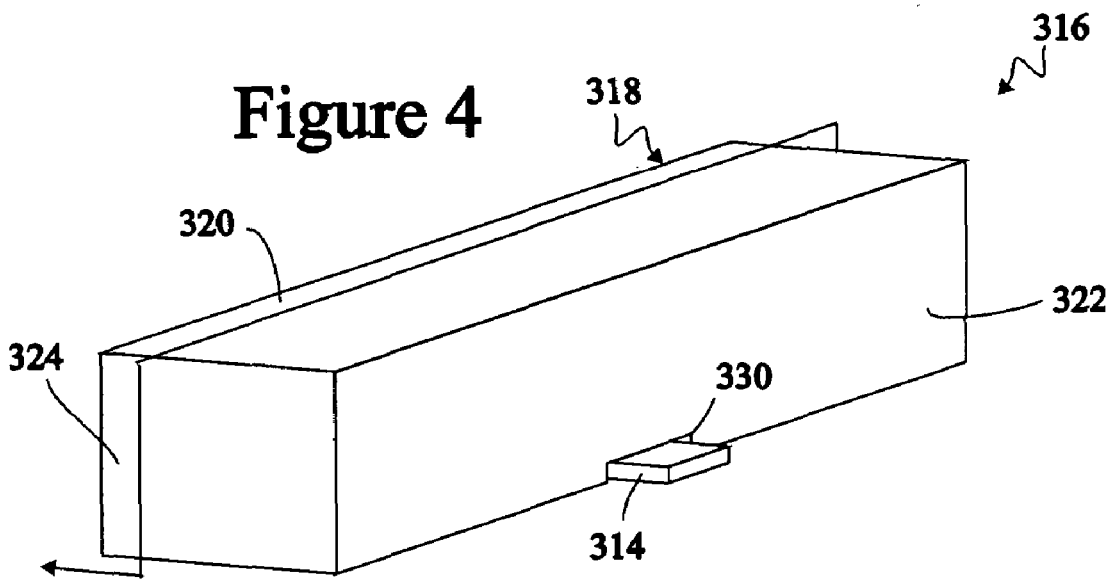
FIG. 4 shows a perspective view the jumper template of FIG. 3 fitted onto the jumper block of FIG. 3.

The structure of jumper template 316 may take any suitable form. In the example shown in FIG. 3 (see also FIGS. 4, 5, 6, and 7), jumper template 316 includes four side walls 322, 324, 326, and 328 as well as a top plate 320. As shown in FIG. 3 and FIG. 4 (which shows jumper template 316 fitted over jumper block 302), the jumper template 316 and jumper block 302 may be keyed to ensure that the jumper template 316 is properly oriented while it is fitted onto jumper block 302. In the example shown in FIG. 3 and FIG. 4, a sidewall 322 includes a notch 330 that fits onto an extension 314 on jumper block 302. Notch 330 and extension 314 form a key that ensures proper orientation of jumper template 316 with respect to jumper block 302. Alternatively, the proper orientation of the jumper template 316 may be indicated by printing on the top plate 320 or one of the side walls 322, 324, 326, and 328.

Figure 5:
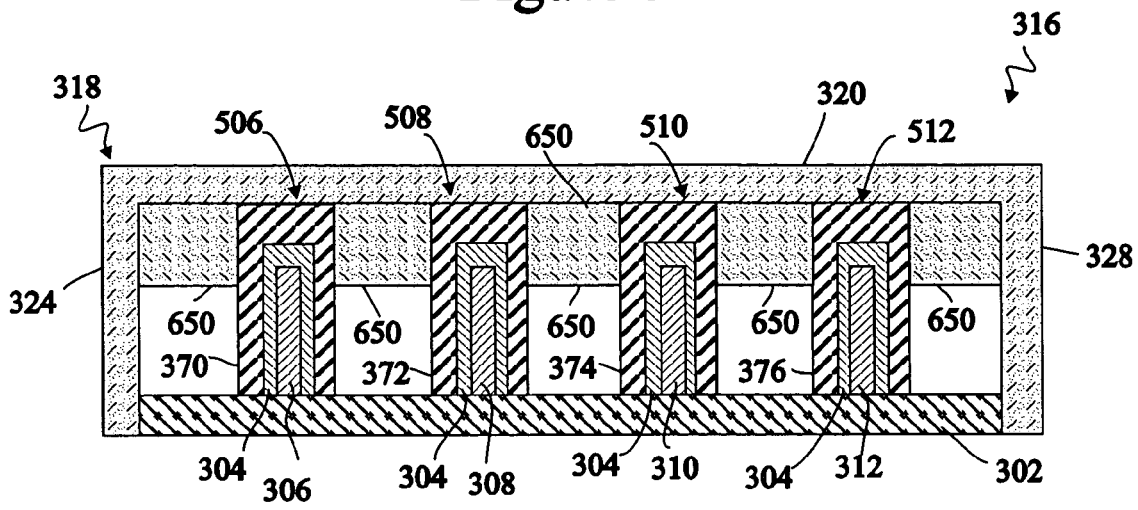
FIG. 5 illustrates a side, cross-sectional view of the jumper template and jumper block of FIG. 4.

FIG. 5 shows a side, cross-sectional view of the jumper template 316 fitted over jumper block 302 (as shown in FIG. 4). Shown in FIG. 5 is a conductive opening 304 in each jumper 370, 372, 374, and 376 for receiving one of the pins in pin pairs 306, 308, 310, and 312.

Figure 6:
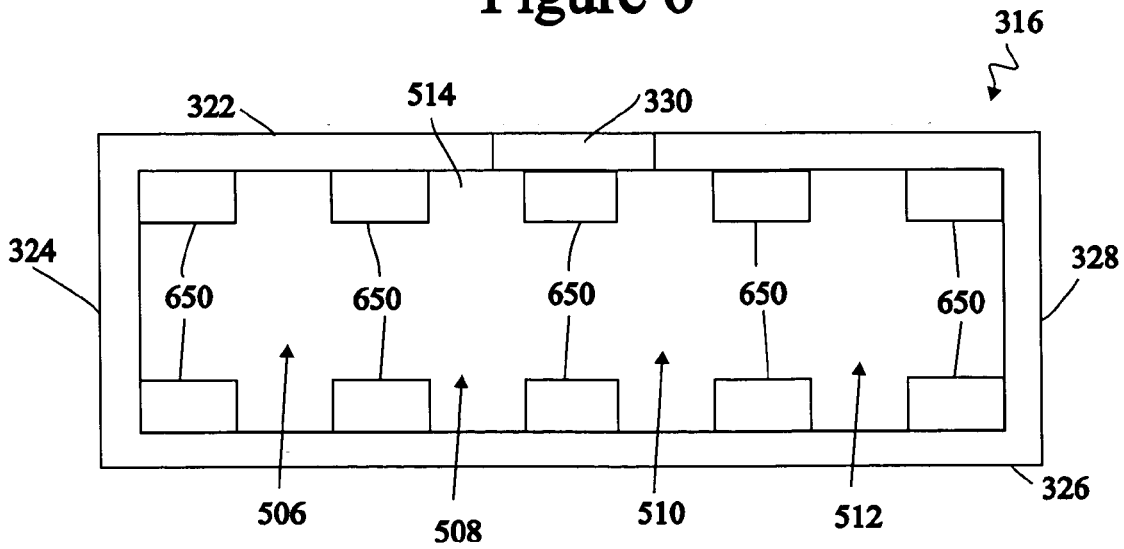
FIG. 6 shows a bottom view of the jumper template of FIG. 3 without jumpers.
Figure 7:
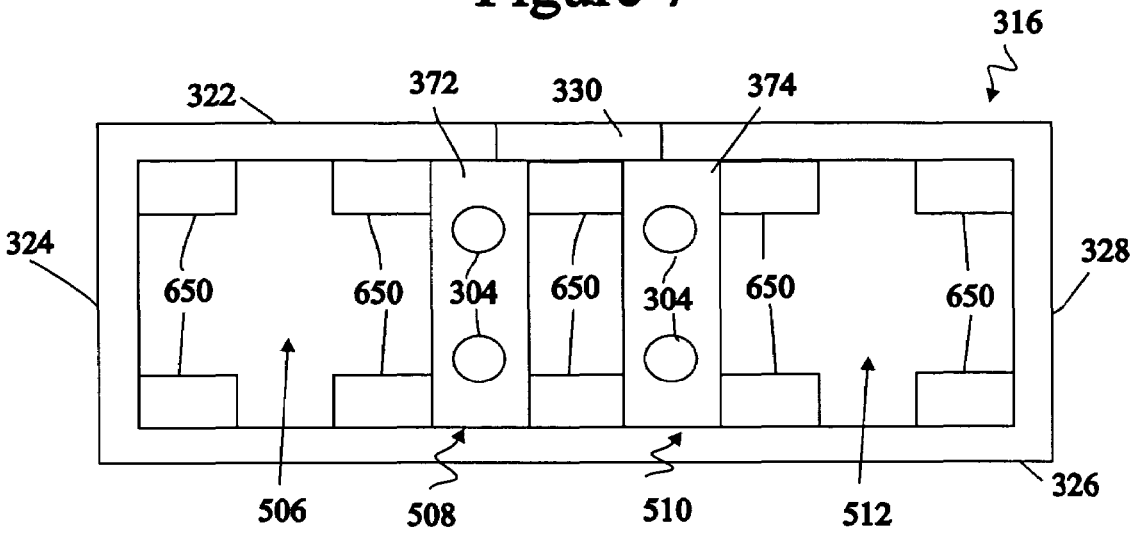
FIG. 7 shows a bottom view of the jumper template of FIG. 3 with two jumpers.

As shown in FIG. 5 and FIG. 6 (which shows a bottom view of jumper template 316), ribs 650 may define slots 506, 508, 510, and 512 for holding a jumper. (No jumpers are shown in FIG. 6.) FIG. 7, which also shows a bottom view of template 316, shows slots 506 and 512 (which correspond to pin pairs 306 and 312 on the jumper block 302) empty, and jumpers 374 and 376 (with conductive openings 304 for pins on jumper block 302) disposed in slots 508 and 510. Jumpers (e.g., 372 and 374) may be disposed in the slots (e.g., 508 and 510) in any suitable manner. For example, a jumper (e.g., 372) may be glued or otherwise adhered into a slot (e.g., 508). As another example, a jumper (e.g., 372) may be friction fit into a slot (e.g., 508). As yet another example, a jumper (e.g., 372) may be snap fit (not shown) into a slot (e.g., 508).

Housing 318 may be made in any suitable manner and of any suitable material. For example, the side walls 322, 324, 326, and 328 and top plate 320 may be integrally formed or may be made separately from each other and assembled. The housing may be made of plastic, rubber, metal, etc. Of course, jumper block 302 may have more or fewer than four pin pairs 306, 308, 310, and 312, and jumper template 316 would consequently include a corresponding more or fewer number of spaces for jumpers. Many other alternatives are also possible. For example, the housing 322 and the jumpers 370 may be integrally formed from one non-conductive material (e.g., plastic, rubber, etc) and metal embedded in the jumper holes such that pairs of jumper holes are electrically connected.

Figure 8:
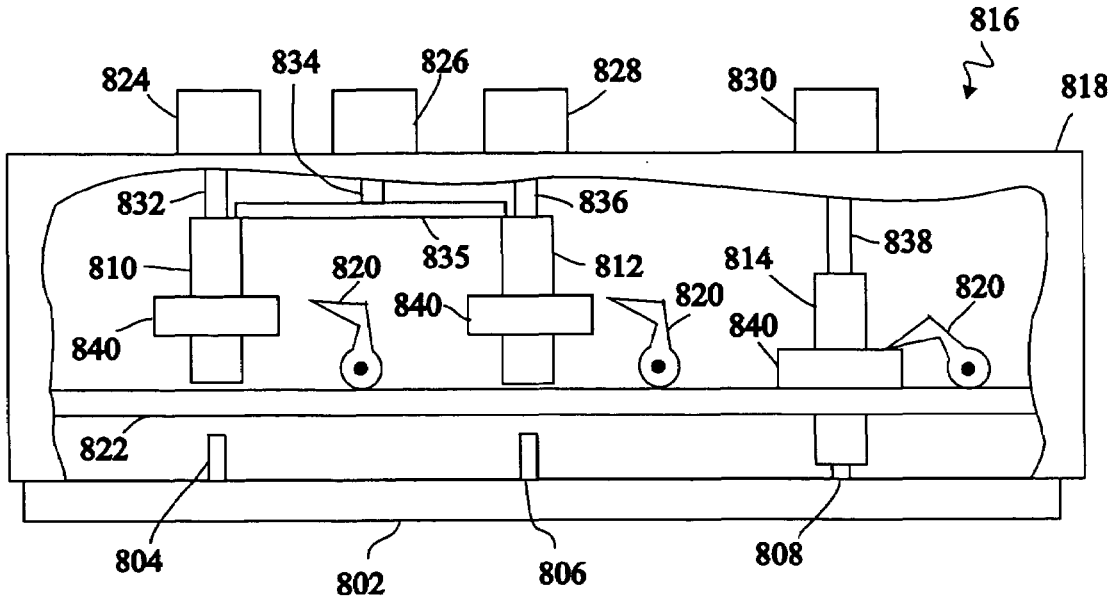
FIG. 8 shows another exemplary jumper template.
Figure 9:
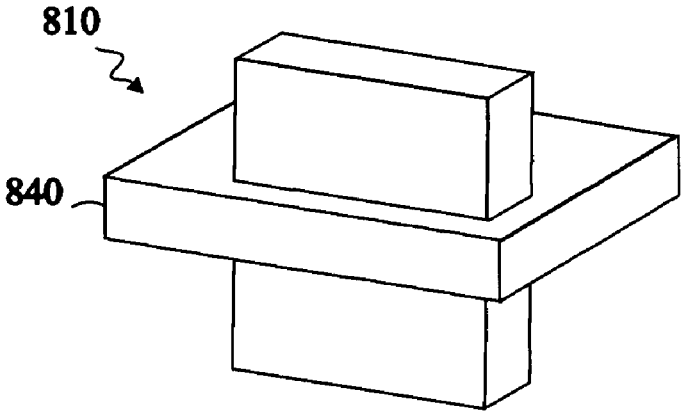
FIG. 9 shows an exemplary jumper for use with the jumper plate of FIG. 8.

FIG. 8 illustrates another exemplary jumper template 816. FIG. 8 shows a side view with a cut out of a housing 818 fit over a jumper block jumper block 802. Jumper block 802 includes three pin pairs 804, 806, and 808. Jumper template 816 holds three jumpers 810, 812, and 814, each corresponding to one of pin pairs 804, 806, and 808. Each jumper 810, 812, and 814 is moveable between a first position in which the jumper does not engage a pin pair 804, 806, and 808 and a second position in which the jumper engages a pin pair. Jumpers 810 and 812 are shown in FIG. 8 in the first position, where they do not engage pin pairs 804 and 806. Jumper 814 is shown in FIG. 8 in the second position, where it engages pin pair 808. A plurality of buttons 824, 826, 828, and 830 may be configured to control movement of one or a set of jumpers 810, 812, and 814 into the second position (where the jumpers engage pin pairs) and the other jumpers into the first position (where the jumpers do not engage pin pairs). In the example shown in FIG. 8, button 824 moves, via connector 832, jumper 810 into the second position (where it engages pin pair 804) and moves jumpers 812 and 814 into the first position (where they do not engage pin pairs 806 and 808). Button 826 moves, via connectors 834 and 835, jumpers 810 and 812 into the second position (where they engage pin pairs 804 and 806) and moves jumper 814 into the first position (where it does not engage pin pair 808). Button 828 moves, via connector 836, jumper 812 into the second position and jumpers 810 and 812 into the first position, and button 830 moves, via connector 838, jumper 814 into the second position and jumpers 810 and 812 into the first position. Thus, button 824 corresponds to a setting for jumper block 802 in which only pin pair 804 is shorted with a jumper; button 826 corresponds to a setting for jumper block 802 in which only pin pairs 804 and 806 are shorted with jumpers; button 828 corresponds to a setting for jumper block 802 in which only pin pair 806 is shorted with a jumper; and button 830 corresponds to a setting for jumper block 802 in which only pin pair 808 is shorted with a jumper. In this example, it may be assumed that the foregoing are the only permissible settings for jumper block 802. If additional settings are possible, additional buttons may be provided.

Buttons 824, 826, 828, and 830, connectors 832, 834, 835, 836, and 838, and/or jumpers 810, 812, and 814 may be spring loaded (not shown) so that jumpers 810, 812, and 814 are biased into the first position (where the jumpers do not engage pin pairs 804, 806, and 808). One or more rails 822, which may be configured to block a rim 840 on each of the jumpers 810, 812, and 814, to define the second position (where the jumpers engage pin pairs 804, 806, and 808). Spring hooks 820, may be configured to hold jumpers in the second position against rail 822 in opposition to the spring loaded biasing of the jumpers into the first position. Upon initial activation of any button 824, 826, 828, and 830, hooks 820 are rotated to release all jumpers 810, 812, and 814 allowing them to move to the first position. Further activation of the button pushes the selected jumper or jumpers 810, 812, and/or 814 into the second position against rail 822 where the jumper or jumpers are latched and held into the second position by corresponding hooks 820. Other configurations of buttons, springs, hooks, and/or other mechanisms may alternatively be used to configure jumper template 816 such that each of a plurality of buttons or other selectors put only particular jumpers into position to short pin pairs on jumper block 802.

Figure 10:
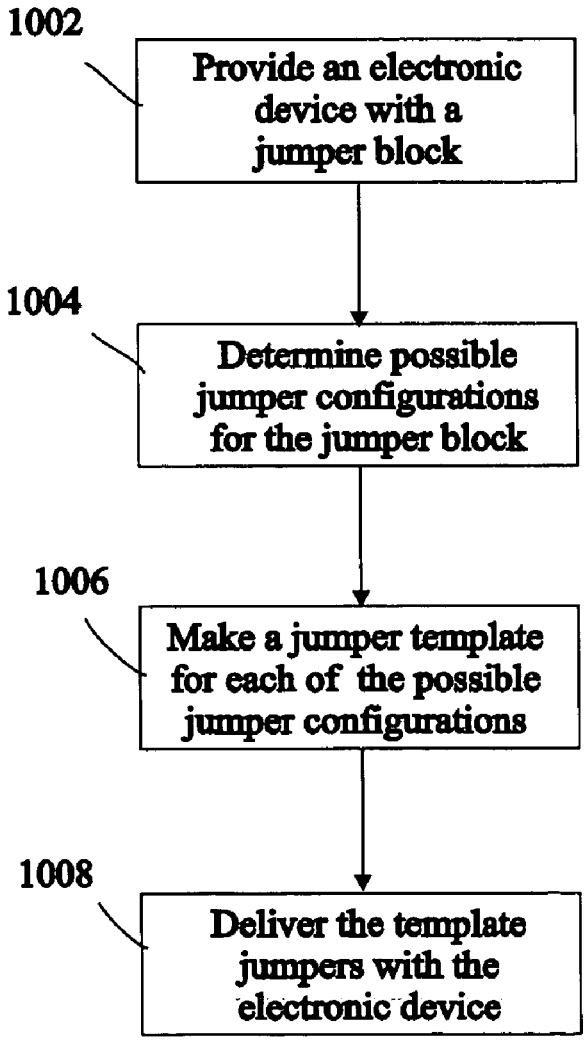
FIG. 10 shows an exemplary method for making jumper templates.

FIG. 10 illustrates an exemplary method of making a plurality of jumper templates (e.g., 316 or 816) each configured to hold one or more combinations of jumpers corresponding to each permissible setting of a particular jumper block (e.g., 302 or 802). As shown in FIG. 10, an electronic device having a jumper block is provided at step 1002. The jumper block may be like jumper block 302 or 802. The electronic device may be any type of electronic device, including without limitation a computer mother board, a disk drive, etc. At step 1004, all permissible settings of the jumper block are identified. That is, permissible combinations of shorted (or "jumped") pin pairs on the jumper block are identified. At step 1006, a jumper template is made for each of the permissible settings of the jumper block identified at step 1004. For example, the jumper templates may be like template 316 shown in FIG. 3, and one such jumper template may be made for each permissible setting of the jumper block identified at step 1004. Alternatively, one jumper template may be made like template 816 shown in FIG. 8 with switches for selecting the different jumper configurations corresponding to the settings identified at step 1004. At step 1008, the jumper templates made at step 1006 are delivered with the electronic device to customers. Directions may also be provided identifying each possible jumper setting and its corresponding jumper template (or button if the template is like template 816 in FIG. 8).

A customer may thus receive a plurality of jumper templates (e.g., like template 316), each configured with jumpers to correspond to one of the permissible jumper settings of the jumper block on the electronic document. The customer then simply selects the jumper template that corresponds to the jumper settings he or she desires and fits the jumper template over the jumper block. Rather than separate directions (or in addition to separate directions), directions may be printed on the housing (e.g., 318 or 818) of each jumper template (e.g., 316 and 318). For example, the name of the setting a particular jumper template effects may be printed on the housing (e.g., 318 and 818). For example, for a jumper block with two settings for selecting whether a particular disk interface on a motherboard is to be master or slave, two jumper templates may be made and the name "master" or "slave" printed on each jumper template. As another example, the jumper templates may coded (e.g., using color or other markings) to identify the particular configuration of a jumper template. Such coding may also indicate a proper orientation of the jumper template with respect to the jumper block.

Figure 11:
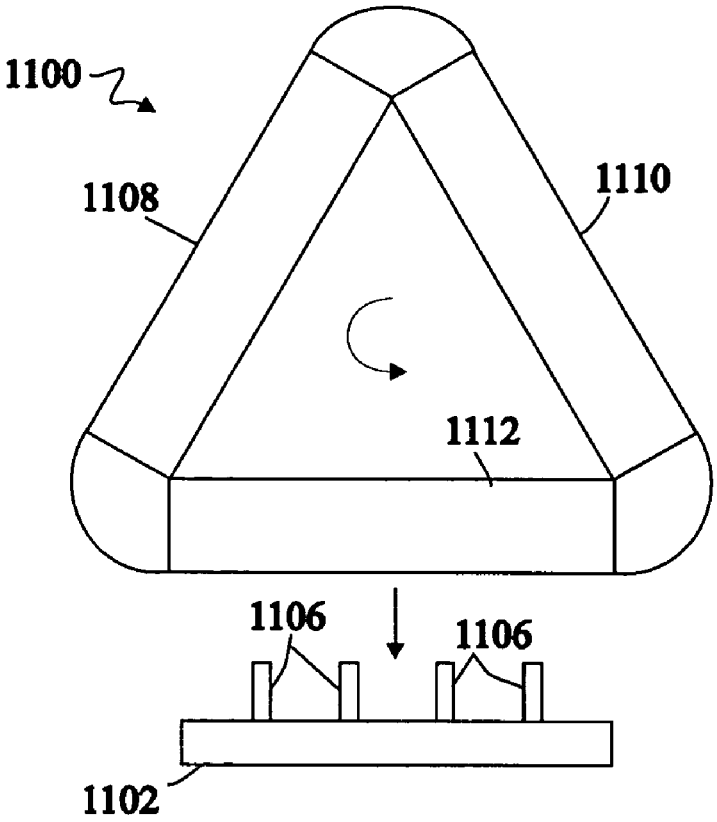
FIG. 11 and FIG. 12 illustrate exemplary multi-template structures.
Figure 12:
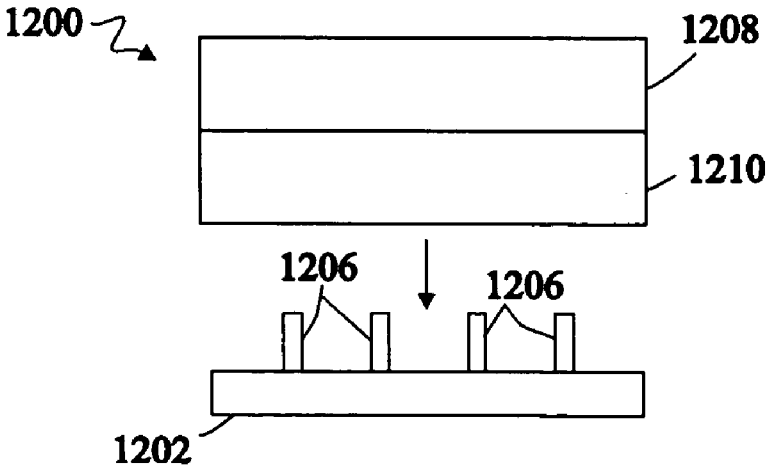

FIG. 11 and FIG. 12 illustrate side views of examples of multi-template structures 1100 and 1200.

In the example shown in FIG. 11, three jumper templates 1108, 1110, and 1112 are connected in a triangular shape. Each jumper template 1108, 1110, and 1112 may be similar to jumper template 316 shown in FIG. 3 and discussed above. That is, although not shown in FIG. 11, each jumper template 1108, 1110, and 112 has a different configurations of jumpers, each configuration corresponding to a possible setting of pin pairs 1106 of jumper block 1102, which may be similar to jumper block 302, also shown in FIG. 3 and discussed above. One of the jumper templates 1108, 1110, and 1112 is selected, rotated to correspond to jumper block 1102, and pushed onto pin pairs 1106. In FIG. 11, jumper template 1112 is shown as the selected jumper template, and it has been rotated to face jumper block 1102. Either of jumper templates 1108 or 1110 could, alternatively, be selected and rotated into the position in which jumper template 1112 is shown in FIG. 11. Of course, printed directions, color coding, or other indicia could be put onto each of jumper templates 1108, 1110, and 1112 to identify the particular configuration of jumper block 1102 that each jumper template 1108, 1110, and 112 corresponds to. It should be noted that the two jumper blocks (1108 and 1110 in FIG. 11) that are not selected may function as a handle by which the multi-template housing 1100 may be picked up, positioned, and pushed onto pin pairs 1106.

In the example shown in FIG. 12, two jumper templates 1208 and 1210 are attached to each other. Again, the jumper templates 1208 and 1210 may be similar to jumper template 316 shown in FIG. 3 and discussed above. Each jumper template 1208 and 1210 contains a different configuration of jumpers (not shown in FIG. 12) and thus each jumper template 1208 and 1210 corresponds to a different setting for jumper block 1202, which includes pin pairs 1206. In FIG. 12, one jumper template is selected, positioned above the jumper block 1202, as shown in FIG. 12, and pushed onto pin pairs 1206. In FIG. 12, jumper template 1210 is shown as the selected jumper template that is to be pushed onto pin pairs 1206. Jumper template 1208 would be selected by rotating the multi-block template one-hundred and eighty degrees so that jumper template 108 is in the position of jumper template 1210 shown in FIG. 12 and then pushing jumper template 1208 onto pin pairs 1206.

As yet another alternative, the customer may receive one jumper template with means for selecting different jumper settings (e.g., like jumper template 816). The customer then simply actives the selection means (e.g., buttons 824, 826, 828, and 830) to select the desired settings for the jumper template.

Although exemplary embodiments and applications of the invention have been described herein, there is no intention that the invention be limited to these exemplary embodiments and applications or to the manner in which the exemplary embodiments and applications operate or are described herein. Indeed, many variations and modifications to the exemplary embodiments are possible. For example, the housings 318 and 818 described above may be replaced by a simpler holding structure not having four walls and a top plate.

The invention claimed is:

1. An apparatus for use with a jumper block comprising a number of pin pairs, said apparatus comprising:

a holding structure comprising one or more spaces, each space configured to hold a jumper corresponding to a pin pair of said jumper block, wherein said holding structure further comprises a housing configured to be selectively coupled to said jumper block, said housing having one or more jumpers disposed within said housing in said spaces of said holding structure wherein said spaces of said holding structure are configured so that each said jumper disposed in said spaces of said holding structure may assume one of two positions while said housing is coupled to said jumper block:

a first non-engaging position wherein said jumper does not engage said corresponding pin pair; and a second engaging position wherein said jumper engages said corresponding pin pair;

a first button corresponding to a permissible setting of said jumper block coupled to one jumper for selectively moving one jumper between the first non-engaging position and the second engaging position in relation to said corresponding pin pair while said housing is coupled to said jumper block; and a second button corresponding to a different permissible setting of said jumper block coupled to at least two jumpers to simultaneously engage said at least two jumpers with at least two corresponding pin pairs, wherein one of said at least two jumpers is said jumper coupled to said first button.

2. The apparatus of claim 1, wherein said holding structure is configured to fit onto said jumper block.

3. The apparatus of claim 1, wherein said holding structure further comprises a key feature that corresponds to a matching key feature on said jumper block, said key feature defining a proper orientation of said holding structure with respect to said jumper block.

4. The apparatus of claim 1, wherein said one jumper is one of said at least two jumpers.

5. The apparatus of claim 1, further comprising a plurality of said holding structures each configured with one or more unique sets of jumpers that corresponds to usable settings of said jumper block, wherein each of said holding structures is attached to another of said holding structures.

6. The apparatus of claim 5, wherein said plurality of said holding structures comprise three holding structures coupled in a triangular configuration.

7. The apparatus of claim 1, wherein said holding structure comprises a color coding identifying at least one of:

(i) an orientation of said holding structure with respect to said jumper block; and (ii) at least one setting of said jumper block.

8. A method of making a plurality of jumper templates for a jumper block comprising a number of pin pairs, said method comprising:

identifying permissible jumper settings for said jumper block; and making a plurality of jumper templates, each said jumper template comprising:

a holding structure comprising one or more spaces, each space configured to hold a jumper corresponding to a pin pair of said jumper block, wherein said holding structure further comprises a housing configured to be selectively coupled to said jumper block, said housing having one or more jumpers disposed within said housing in said spaces of said holding structure so as to correspond to one or more of said permissible jumper settings;

a first button coupled to one jumper for selectively moving one jumper between a first non-engaging position and a second engaging position in relation to said corresponding pin pair while said housing is coupled to said jumper block; and a second button coupled to at least two jumpers to simultaneously engage said at least two jumpers with at least two corresponding pin pairs, wherein one of said at least two jumpers is said jumper coupled to said first button.

9. The method of claim 8, wherein each said jumper template is configured to fit onto said jumper block.

10. The method of claim 9, wherein said holding structure further comprises a key feature that corresponds to a matching key feature on said jumper block, said key feature defining a proper orientation of said holding structure with respect to said jumper block.

11. A method of making a jumper template for a jumper block comprising a number of pin pairs, said method comprising:

providing a holding structure comprising a housing configured to be selectively coupled to said jumper block;

disposing one or more jumpers within said housing so as to correspond to one or more corresponding pin pairs of said jumper block identifying permissible jumper settings for said jumper block;

configuring a first button of said jumper template for selectively engaging one of said jumpers to one of said corresponding pin pairs while said jumper template is fit onto said jumper block; and configuring a second button of said jumper template for simultaneously engaging at least two of said jumpers to at least two of said corresponding pin pairs while said jumper template is fit onto said jumper block, wherein one of said at least two jumpers is said jumper coupled to said first button.

12. The method of claim 11, further comprising using a key feature of said holding structure that corresponds to a matching key feature on said jumper block to define a proper orientation of said holding structure with respect to said jumper block.

* * * * *